US006884955B1

(12) United States Patent
Yu

(10) Patent No.: US 6,884,955 B1
(45) Date of Patent: Apr. 26, 2005

(54) CIRCUIT BREAKER ON A PUSHBUTTON SWITCH HAVING A LINKAGE MOVABLY CONNECTED TO THE PUSHBUTTON SO AS TO ALLOW FREE MOVEMENT OF A HEAT SENSITIVE PLATE

(76) Inventor: Tsung-Mou Yu, No. 4, Alley 2, Lane 23, Sec. 3. Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/829,116

(22) Filed: Apr. 20, 2004

(51) Int. Cl.[7] ..... H01H 21/00
(52) U.S. Cl. ..... 200/553; 200/339
(58) Field of Search ..... 200/553, 529, 200/520, 339, 556–562, 329, 341

(56) References Cited

U.S. PATENT DOCUMENTS

| | | | | |
|---|---|---|---|---|
| 4,167,720 A | | 9/1979 | Krasser | 337/60 |
| 4,937,548 A | | 6/1990 | Sdunek | 337/70 |
| 5,223,813 A | | 6/1993 | Cambreleng et al. | 337/66 |
| 5,451,729 A | | 9/1995 | Onderka et al. | 200/18 |
| 5,558,211 A | | 9/1996 | Heydner et al. | 200/553 |
| 5,626,748 A | | 5/1997 | Rose | 210/241 |
| 5,898,355 A | * | 4/1999 | Yu | 337/8 |
| 6,452,125 B1 | * | 9/2002 | Yu | 200/553 |
| 6,753,491 B1 | * | 6/2004 | Huang | 200/400 |

* cited by examiner

*Primary Examiner*—Lincoln Donovan
*Assistant Examiner*—M. Fishman

(57) ABSTRACT

A pushbutton switch has a pushbutton having a slot receive therein a free end of the linkage and a receiving space in communication with the slot so as to allow the free end of the linkage to move toward the receiving space when an electrical overload occurs in the pushbutton switch. The linkage has a cutout defined in the second distal end to have a portion of the heat sensitive plate to be received in the cutout and an extension formed with the linkage and extending out into the slot. Therefore, when the heat sensitive plate reacts to heat and curves to cause the first contact to separate from the second contact, a free end of the linkage received inside the slot is able to move toward the receiving space to allow a free movement of the heat sensitive plate without any limitation to hinder the curvature movement of the heat sensitive plate.

2 Claims, 7 Drawing Sheets

(OFF)

(OFF)

CIRCUIT BREAKER ON A PUSHBUTTON SWITCH HAVING A LINKAGE MOVABLY CONNECTED TO THE PUSHBUTTON SO AS TO ALLOW FREE MOVEMENT OF A HEAT SENSITIVE PLATE

BACKGROUND OF THE INVENTION

1. Field of the Invention

The present invention relates to a circuit breaker, and more particularly to a circuit breaker on a pushbutton switch having a pushbutton pivotally mounted on the pushbutton switch to ensure a power disconnection in the circuitry when there is an overload.

2. Description of Related Art

A conventional circuit breaker uses a fuse between the switch and the circuit such that when there is an electrical overload, the fuse will first melt before the overload causes damage. However, when the fuse dimension is not proper to adapt to the voltage in the circuit, an electrical overload in the circuit will not melt the fuse and still causes disaster. Therefore, a different design is employed to ensure power cut-off in a dangerous situation. U.S. Pat. Nos. 5,626,748, 4,167,720, 4,937,548, 5,223,813, 5,451,729, and 5,558,211 all disclose circuit breakers of different types. Although these patents do have the predetermined effect to automatically cause a temporary power outage, they still suffer a large variety of problems:

(1) Too many elements: Because there are too many elements in the circuit breaker, the movement of the elements inside the circuit breaker is complex and complicated, which causes the manufacture cost high.

(2) Not real time movement of element: Because of the number of elements, when there is an electrical overload in the circuit, sometimes, a heat sensitive plate usually used in the circuit breaker is not able to work properly to cause a temporary power outage. That is, normally the heat sensitive plate will curve away from engagement with the contact to cause a temporary power outage. However, if the heat sensitive plate is not able to disengage with the contact in time or completely, the circuit will become overheat and thus a disaster happens.

The curvature movement of the heat sensitive plate to disengage with the contact while the temperature of the heat sensitive plate is over a predetermined temperature and the curvature movement of the heat sensitive plate to engage with the contact while the temperature of the heat sensitive plate is lower than the predetermined temperature often cause sparks, which easily causes a fire and malfunction to the electronic devices.

To overcome the shortcomings, the present invention intends to provide an improved circuit breaker to mitigate the aforementioned problems.

SUMMARY OF THE INVENTION

The primary objective of the invention is to provide an improved circuit breaker on a pushbutton switch such that the movement of the pushbutton in a first direction causes a movement of a linkage to drive a heat sensitive plate to engage with a contact that is formed on a terminal to have the circuit of the pushbutton switch completed. When there is an electrical overload in the pushbutton switch, the curvature movement of the sensitive plate causes the linkage to move into a space in the pushbutton such that the heat sensitive plate is disengaged with the contact and thus a temporary power outage is completed.

Other objects, advantages, and novel features of the invention will become more apparent from the following detailed description when taken in conjunction with the accompanying drawings.

BRIEF DESCRIPTION OF THE DRAWINGS

FIG. 2 is a schematic view showing the internal arrangement of the pushbutton switch of the present invention when the pushbutton is switched on;

FIG. 6 is an enlarged schematic view showing the position of the linkage relative to the pushbutton when the pushbutton is switched on.

DETAILED DESCRIPTION OF PREFERRED EMBODIMENT

Figure 1:
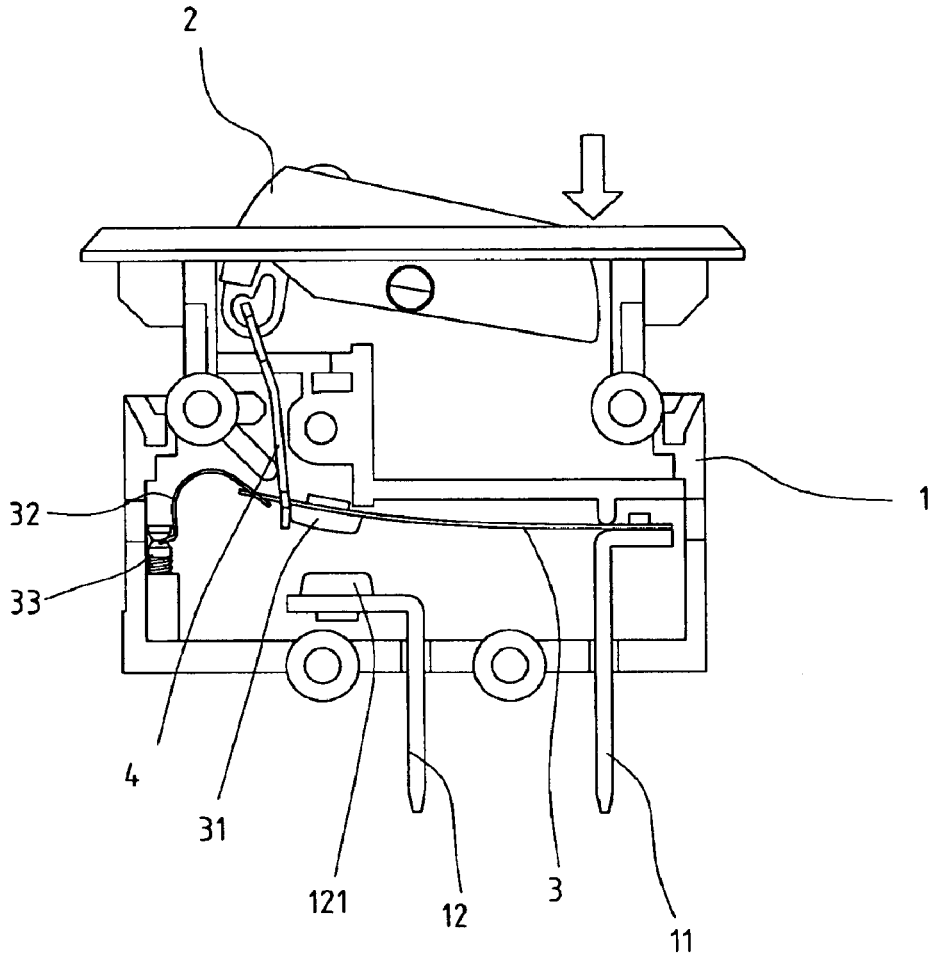
FIG. 1 is a schematic view showing the internal arrangement of the pushbutton switch of the present invention when the pushbutton is switched off.
Figure 2:
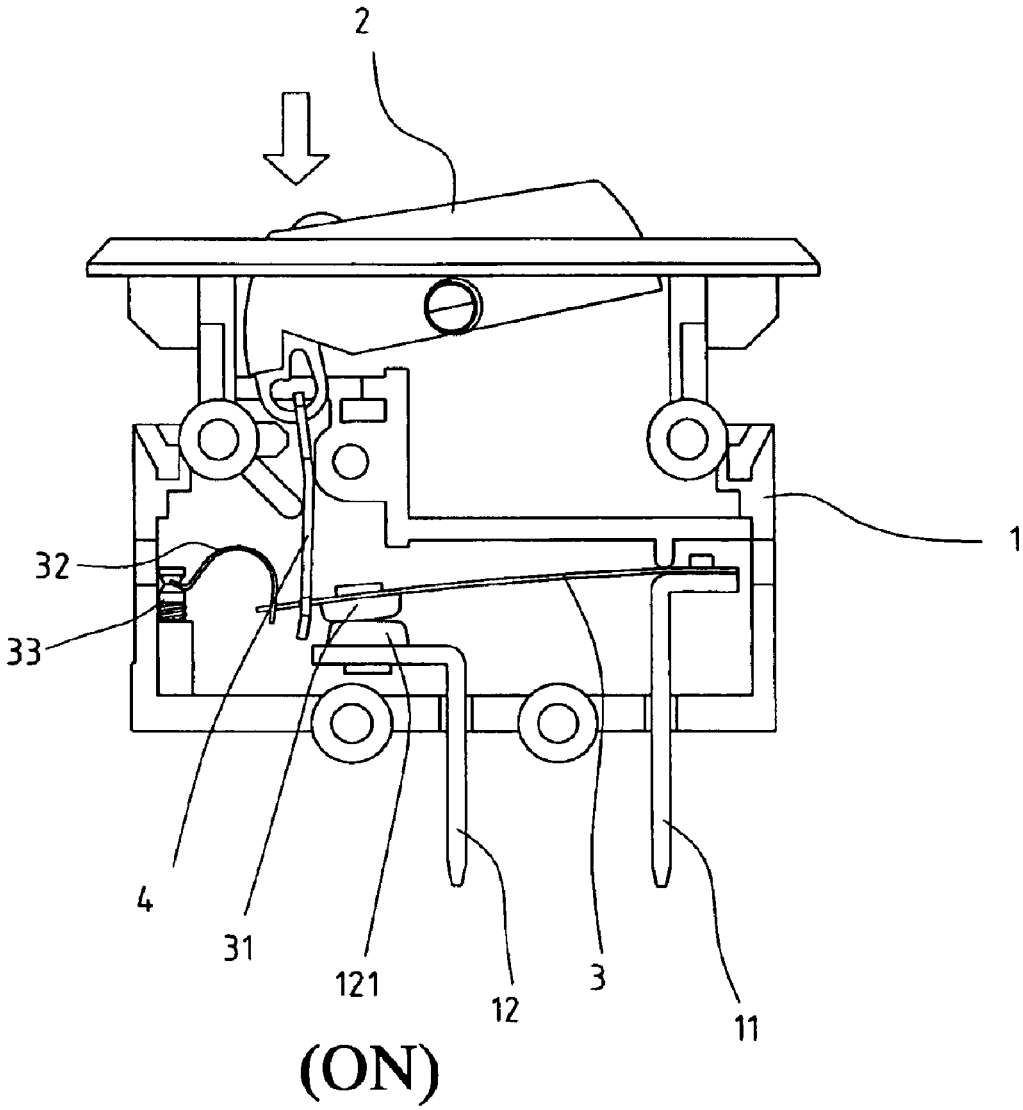
Figure 3:
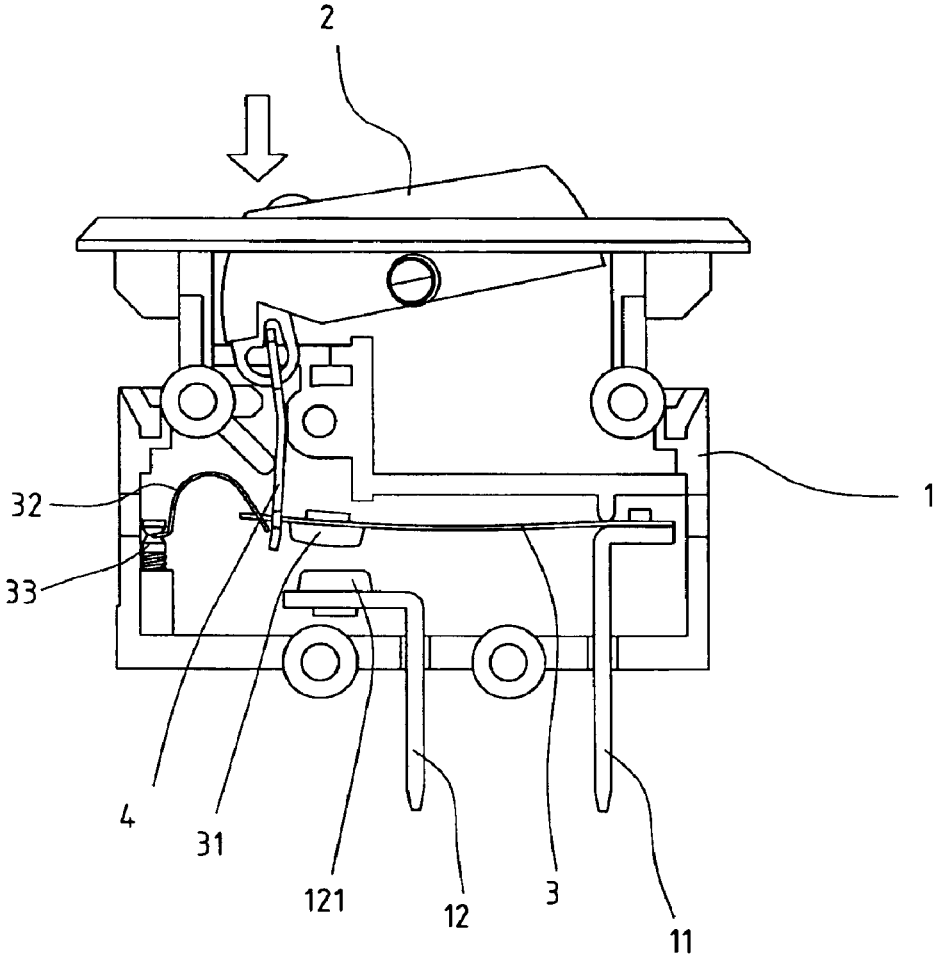
FIG. 3 is a schematic view showing a different embodiment of the pushbutton switch of the present invention.

With reference to FIGS. 1–3, a pushbutton switch in accordance with the present invention includes a casing 1, a pushbutton 2, a heat sensitive plate 3, and a linkage 4.

The casing 1 is hollow inside and has an open end defined in a top portion of the casing 1. The casing 1 further has at least two terminals, namely a first terminal 11 and a second terminal 12. The first terminal 11 has a first distal end securely engaged with a distal end of the heat sensitive plate 3 and a second distal end extending out of a bottom face of the casing 1. The second terminal 12 has a first distal end provided with a first contact 121 formed on a bend (not numbered) on the first distal end of the second terminal 12 and a second distal end extending out from the bottom face of the casing 1.

Figure 4:
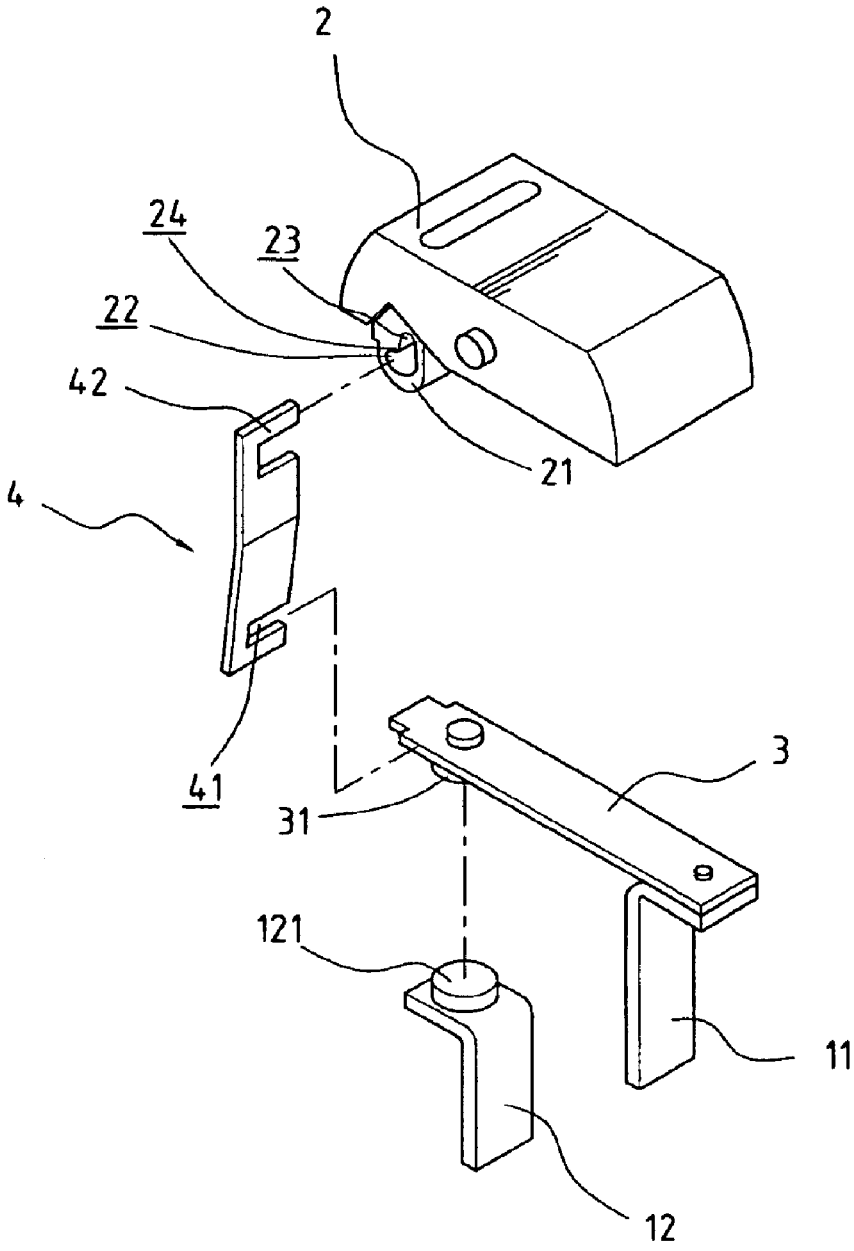
FIG. 4 is an exploded perspective view showing the structural relationship among the pushbutton, the linkage, the heat sensitive plate, and the terminal.

With reference to FIG. 4, it is noted that the pushbutton 2 is formed with a boss 21, a slot 22 defined inside the boss 21 and a receiving space 23 in communication with the slot 22. The heat sensitive plate 3 has a first distal end securely connected to the first distal end of the first terminal 11 and a second distal end formed with a second contact 31. The linkage 4 has a first distal end provided with a cutout 41 to correspond to and receive the second distal end of the heat sensitive plate 3 and a second distal end provided with an extension 42 to be extending out and received inside the slot 22.

Figure 6:
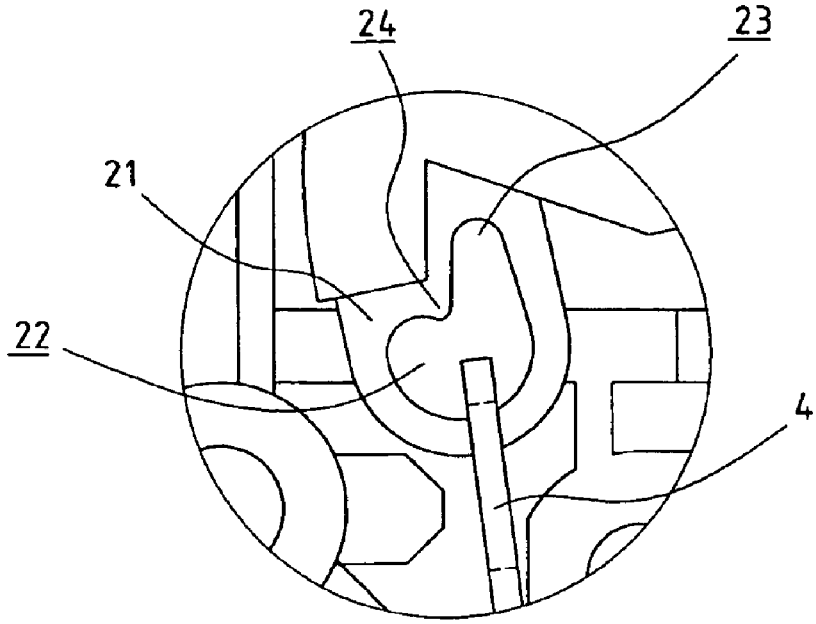

When the pushbutton switch of the present invention is assembled, it is noted that the extension 42 is received inside the slot 22 and the second distal end of the heat sensitive plate 3 is received in the cutout 41. Thereafter, when the pushbutton switch of the present invention is in application and the pushbutton 2 is pressed to cause the circuit of the pushbutton switch closed (the firs contact 121 and the second contact 31 are engaged with each other), as shown in FIGS. 2 and 6, the free end of the linkage 4 is received in the slot 22.

When there is an electrical overload, the heat sensitive plate 3 reacts to heat and thus the heat sensitive plate 3 bends toward a direction causing the first contact 121 to be away from engagement with the second contact 31, which opens the circuit of the pushbutton switch of the present invention. In the meantime, due to the curvature movement of the heat sensitive plate 3, the free end of the linkage 4 is pushed by the heat sensitive plate 3 to enter the receiving space 23 from the slot 22. The movement of the linkage 4 from the slot 22 to the receiving space 23 due to the movement of the heat sensitive plate 3 allows the movement of the heat sensitive plate 3 free of any limitation. Thus the separation between the first contact 121 and the second contact 31 is ensured.

Figure 5:
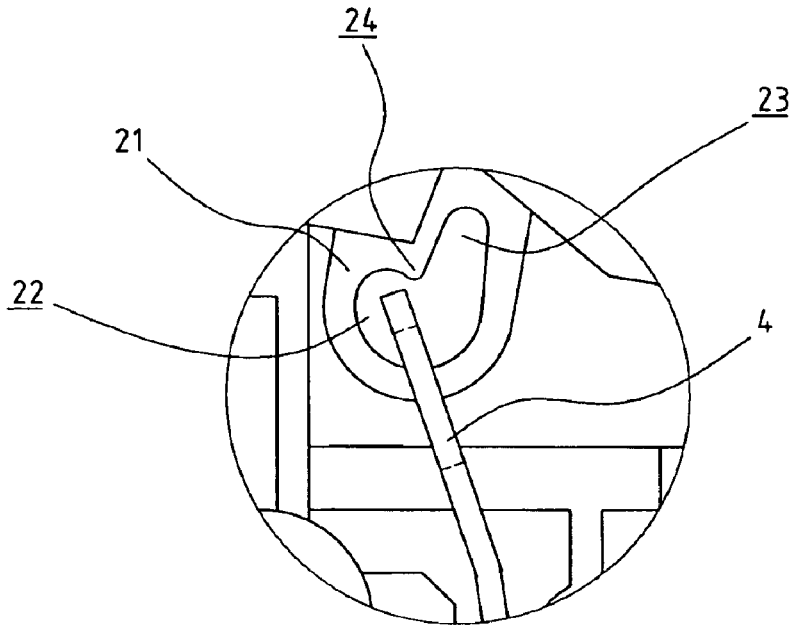
FIG. 5 is an enlarged schematic view showing the position of the linkage relative to the pushbutton when the pushbutton is switched off.

With reference to FIGS. 1 and 5, it is noted when the pushbutton 2 of the present invention is pressed again to cause the circuit open (the first contact 121 and the second contact 31 are separated from each other), the free end of the linkage 4 is received inside the slot 22.

Figure 7:
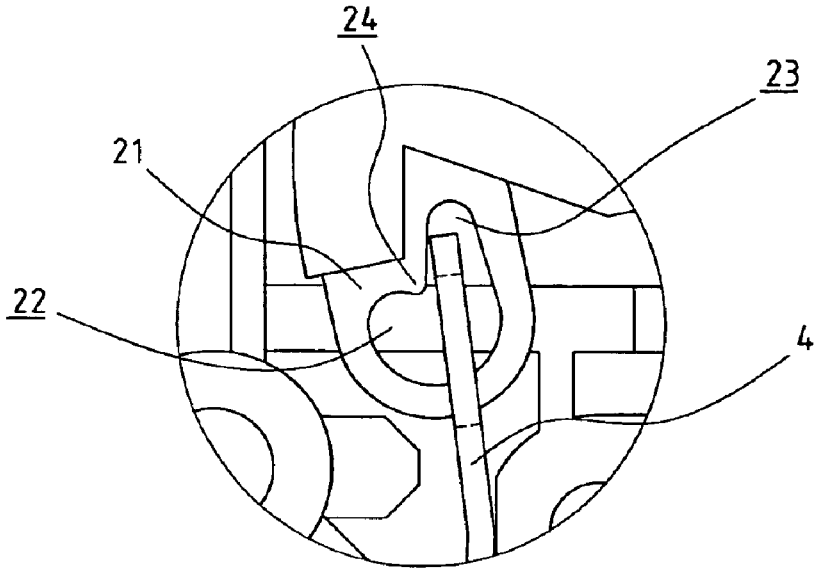
FIG. 7 is an enlarged schematic view showing the relative position between the linkage and the heat sensitive plate.

With reference to FIGS. 3 and 7, it is noted that when an electrical overload occurs in the pushbutton switch of the present invention, in order to ensure that the free end of the linkage 4 is able to smoothly slide from the slot 22 to the receiving space 23, at the joint between the slot 22 and the receiving space 23, an arcuate corner 24 is formed such that when the free end of the linkage 4 is moved by the curvature movement of the heat sensitive plate 3, the sliding movement of the free end of the linkage 4 from the slot 22 to the receiving space 23 is smooth. Furthermore, as shown in FIG. 7, it is noted that a threaded bolt 33 is threadingly mounted inside the casing 1 and a first distal end of a spring 32 is securely in contact with the threaded bolt 33. A second distal end of the spring 32 is in contact with the second distal end of the heat sensitive plate 3. Therefore, when the first contact 121 and the second contact 31 are not in contact with one another, the resilience of the spring 32 ensures the separation between the first and the second contacts 121, 31. When the firs contact 121 and the second contact 31 are in contact with one another, the resilience of the spring 32 ensures that the engagement between the first and the second contacts 121, 31 is solid. Furthermore, when the resilience of the spring 32 is changed, the threaded bolt 33 is able to adjust the resilience of the spring 32 by rotating the threaded bolt 32.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a pushbutton switch having a pushbutton pivotally mounted on a hollow casing, a linkage movably received inside the casing and having a first distal end securely in contact with the pushbutton and a second distal end securely connected to a heat sensitive plate which is able to curve in reaction to heat and has a first distal end securely connected to a first distal end of a first terminal, wherein a second distal end of the first terminal extends out of the casing, a second terminal having a first distal end provided with a first contact mounted thereon and a second distal end extending out of the casing, wherein the heat sensitive plate has a second distal end provided with a second contact selectively in contact with the first contact, wherein the improvements comprises:

the pushbutton having a slot adapted to receive therein a free end of the linkage and a receiving space in communication with the slot so as to allow the free end of the linkage to move toward the receiving space when an electrical overload occurs in the pushbutton switch, and the linkage having a cutout defined in the second distal end to have a portion of the heat sensitive plate to be received in the cutout and an extension formed with the linkage and extending out into the slot, such that when the heat sensitive plate reacts to heat and curves to cause the first contact to separate from the second contact, a free end of the linkage received inside the slot is able to move toward the receiving space to allow a free movement of the heat sensitive plate without any limitation to hinder the curvature movement of the heat sensitive plate.

2. The pushbutton switch as claimed in claim 1 further comprising a threaded bolt threadingly connected to the casing and a spring with a first distal end securely connection to the threaded bolt and a second distal end en contact with the second distal end of the heat sensitive plate.

* * * * *